US009890950B2

(12) United States Patent
Masterson et al.

(10) Patent No.: US 9,890,950 B2
(45) Date of Patent: Feb. 13, 2018

(54) FUEL BURNING SYSTEM AND METHOD

(75) Inventors: Daniel Masterson, Geneva, IL (US); Dipan Surati, Des Plaines, IL (US)

(73) Assignee: Masterson Enterprises Inc., Glendale Heights, IL (US)

( * ) Notice: Subject to any disclaimer, the term of this patent is extended or adjusted under 35 U.S.C. 154(b) by 1294 days.

(21) Appl. No.: 13/640,482

(22) PCT Filed: Jun. 15, 2009

(86) PCT No.: PCT/US2009/047371

§ 371 (c)(1),
(2), (4) Date: Oct. 10, 2012

(87) PCT Pub. No.: WO2009/152502

PCT Pub. Date: Dec. 17, 2009

(65) Prior Publication Data

US 2013/0101946 A1 Apr. 25, 2013

Related U.S. Application Data

(60) Provisional application No. 61/061,378, filed on Jun. 13, 2008.

(51) Int. Cl.
*F23D 3/16* (2006.01)
*F23D 3/18* (2006.01)

(52) U.S. Cl.
CPC ..... *F23D 3/16* (2013.01); *F23D 3/18* (2013.01)

(58) Field of Classification Search
CPC ..... F23D 3/18; F23D 3/24
USPC ..... 431/292, 302, 303
See application file for complete search history.

(56) References Cited

U.S. PATENT DOCUMENTS

| | | | | |
|---|---|---|---|---|
| 1,519,235 | A * | 12/1924 | Ayton-Blake | 431/88 |
| 1,936,663 | A * | 11/1933 | Dennis | 431/325 |
| 4,524,408 | A * | 6/1985 | Minera | 362/163 |
| 6,428,311 | B1 * | 8/2002 | Bernardo | 431/293 |
| 6,695,611 | B2 * | 2/2004 | Lee | 431/293 |
| 6,848,901 | B1 * | 2/2005 | Matsuyama | 431/310 |
| 6,857,869 | B1 * | 2/2005 | Sun | 431/289 |
| 7,442,036 | B2 * | 10/2008 | Kubicek et al. | 431/289 |
| 2001/0005573 | A1 * | 6/2001 | Furner et al. | 431/292 |
| 2001/0053506 | A1 * | 12/2001 | Moon | 431/292 |
| 2006/0057522 | A1 * | 3/2006 | Kubicek et al. | 431/289 |
| 2006/0057529 | A1 * | 3/2006 | Kubicek et al. | 431/325 |
| 2006/0057530 | A1 * | 3/2006 | Kubicek et al. | 431/325 |
| 2006/0084021 | A1 * | 4/2006 | Kubicek | 431/291 |
| 2008/0227043 | A1 * | 9/2008 | Kitt | 431/292 |

* cited by examiner

*Primary Examiner* — Jason Lau
(74) *Attorney, Agent, or Firm* — Erickson Law Group, PC

(57) ABSTRACT

A fuel management system provides a burning system to melt solid fuel and supply the fuel to a wick for producing a larger flame.

20 Claims, 8 Drawing Sheets

FUEL BURNING SYSTEM AND METHOD

CROSS REFERENCE TO RELATED APPLICATIONS

This application claims the priority of U.S. Provisional Patent Application Ser. No. 61/061,378 filed on Jun. 13, 2008, which is hereby incorporated by reference in its entirety.

BACKGROUND OF THE INVENTION

Existing liquid fuel burning apparatuses like lanterns, lamps, and torches are plagued with fuel handling issues, including spills of flammable material, subsequent wicking and transfer to clothing and hands, and other types of difficulties, messes, and hazards. Typical liquid fuel burning systems, because of the flammable nature of the fuel, cannot be refueled without first extinguishing the flame. The U.S. Consumer Product Safety Commission tracks incidents associated with the use of outdoor torch products and details slip hazards with spilled fuel, ingestion hazards of the fuel, accidental absorption of the fuel into the housing, and accidental fires.

Wax burning systems, such as candles, lend themselves to incomplete fuel consumption, especially of wax not in close proximity to the flame In larger candles, this can be seen as the flame slowly bores a hole down through the candle. Existing wax-based solutions sometimes rely on multiple wick systems; however, they too fail to consume all of the wax fuel and self-extinguish prematurely. Wax burning systems that do consume the totality of the wax require the flame to travel down as the wax fuel is consumed.

Some smaller, indoor applications of wax burners are available, but they too fail in several regards. Specifically, in the event a volatile active ingredient is desired, the existing solutions require almost 45 minutes to develop a completely melted pool of wax. Similarly, because the systems use primarily radiant energy from the candle to melt the wax, the diameter of the wax pool is limited and restricted. Also, the surface temperature of the wax pool is lower than ideal because the source of heat is fully buried at the bottom of the wax pool, meaning the full mass of the melted fuel must increase in temperature before an increase in volatile active ingredient is possible. Finally, previous executions fail to segregate any of the melt pool surface from the burning flame, resulting in air currents that preferentially move the volatilized active toward and into the flame, lowering the actual delivery of the active ingredient to the surrounding environment and reducing the product efficacy. For wax burning systems intending to deliver a volatile active ingredient to the air (like a fragrance, insect repellent, medicinal, or physiological active), there is still a need for faster melt pool development, increased surface temperature of that pool, larger melt pools, and segregation of that pool from the flame resulting in faster, more effective, and more complete delivery of the active ingredient.

SUMMARY OF THE INVENTION

The invention included here may be comprised of the following components:

(1) a proximal fuel reservoir used to house the solid fuel that provides for ignition and initial sustaining of the flame.

(2) At least one remote fuel reservoir that houses the bulk of the solid fuel such that it accommodates subsequent melting of the fuel as the proximal fuel reservoir is depleted (3) An ignition point—generally at the top of an appropriate wick (4) An appropriate wick (5) At least one melted fuel reservoir that is in communication with the wick and all of the remote fuel reservoirs. This reservoir is typically beneath the remote fuel reservoir(s).

(6) A heat flux method (conduction, convection, radiation, or any combination of the three) that uses the heat from the flame to melt the fuel in the remote fuel reservoir(s) and optionally the proximal reservoir in order to produce and deliver liquid fuel to the melted fuel reservoir. This heat flux must be designed in such a way as to keep the liquid fuel in its molten or liquid state until the fuel enters the wick and is ultimately consumed by the flame.

By staging the solid fuel in a series of at least two solid fuel reservoirs, the solid fuel burning apparatus can use all of the wax and solve and improve upon all the deficiencies of the existing art without drowning or starving the wick of fuel, both of which would result in extinguishing the flame.

Once lit, the flame immediately begins to melt and consume the fuel held within the proximal solid fuel reservoir. As the proximal fuel reservoir fuel is consumed and ultimately depleted, the flame begins heating and melting the solid fuel held in the remote fuel reservoir(s) by means of sufficient heat flux (via convective, conductive, and/or radiation heat transfer means). As the remote fuel is melted, it is delivered to the melted fuel reservoir where is replenishes the flame through its wick, enabling the system to sustain the flame and thereby continue to deliver heat to the remote fuel reservoir, melt more fuel, deliver liquid fuel to the melted fuel reservoir, and so on until the entirety of the remote fuel reservoir is delivered to the melted fuel reservoir and consumed by the flame. All the while, the flame continues to deliver sufficient heat to the melted fuel reservoir to keep the fuel in its liquid state.

In this system, the proximal reservoir is depleted of fuel first. Before that happens, the remote fuel reservoirs have at least begun to melt the solid fuel and to deliver melted fuel to the melted fuel reservoir to ensure the flame does not run dry of fuel.

Generally, the heat flux moves from the flame outward in a radial direction, typically by conductive methods but can be done using either convection or radiation or any combination of the three heat transfer methods. The system design generally places the remote fuel reservoir above the melted fuel reservoir and delivers the liquid fuel to the latter via a perforated bottom so that simple gravity can ensure the liquid fuel flows to the wick.

This general approach can accommodate any number of product designs (some described below) and can alter the relative performance of each design depending on the product requirements. For example, an outdoor product may want to promote incomplete fuel combustion and soot production to aid in insect repellency while an indoor product should have complete fuel combustion and a more stable flame. As another example, an indoor air freshener might want as large a melt pool surface as possible to facilitate fragrance delivery, lending itself to a shallower product design, while an outdoor item might want a more traditional vertical design but does not require a large melt pool. By altering the relative position, size, and interfacing of the components of this invention, any of these applications (and more) can be accommodated.

Advantages of the Invention:

The following are the advantages of this invention over the comparable prior art:

(1) cleaner filling and cleaner use of a large flame system that traditionally use liquid fuels
(2) ability to safely and easily refuel a lit product
(3) complete wax consumption—no wasted fuel
(4) hotter melt pool for more complete active delivery (if formulated with a volatile active)
(5) faster melt pool development
(6) larger exposure of a melt pool and segregation from the flame for more effective delivery of the active ingredient (if formulated with a volatile active ingredient)
(7) extended burn times
(8) consistent (or non diminishing) flame throughout usage or depletion of the fuel
(9) ability to operate and perform consistently independent of ambient environmental conditions like temperature

DETAILED DESCRIPTION OF THE INVENTION

The invention may be utilized in several different applications using the technology. Three different versions of this invention are depicted in the figures.

Figure 1:
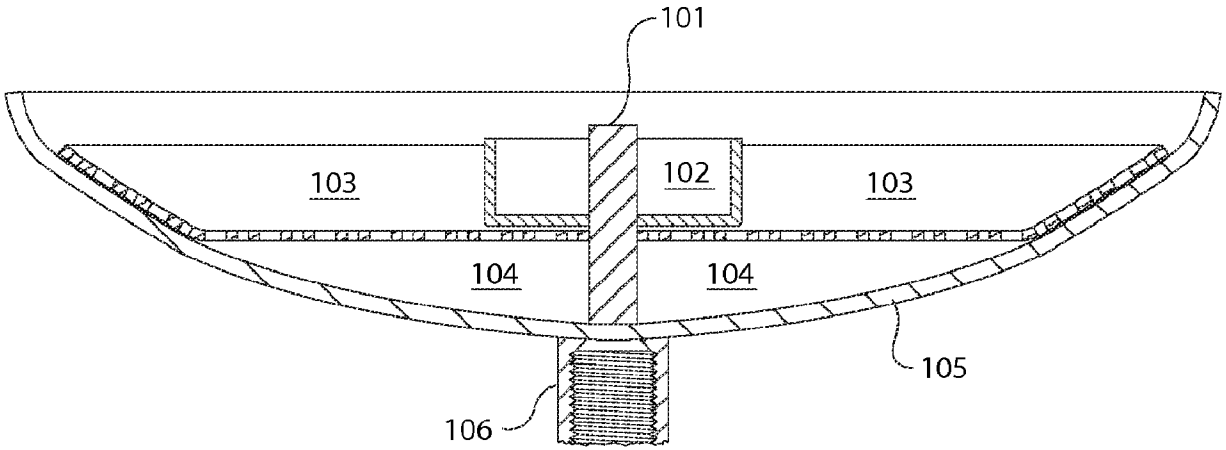
FIG. 1 is a cross-section view of a yard torch embodiment of the invention having a wide basis for ease of filling, use, and volatile delivery.

As shown in FIG. 1, the wick 101 may preferably be a sintered glass rod that acts as a non-consumable wick and has sufficient porosity to transport the liquid fuel to the flame. The glass rod product from MICRO-PORE was found to be suitable. At the same time, the material of the wick 101 assists in transporting heat to the system which aids in initial ignition and subsequent heating of the reservoirs 102, 103, and 104 that house solid and melted wax. The wick 101 or a wick assembly can be made of any suitable transport material including but not limited to sintered glass, sintered metal, porous ceramics, porous metals, porous stone, wood, fiberglass, or cotton. The wick 101 itself can have heat transferring properties, as often in porous ceramics and sintered glass media and porous metals, or the wick 101 can be made up of a combination of materials, for example a fiberglass tubing with a metal rod held within it with the rod acting as both the place to stake the wick 101 and the vehicle for heat transfer.

The wick 101 can be partially sheathed within the proximal fuel reservoir 102 to alter or control the flame height and heating characteristics. The proximal fuel reservoir 102 cups the wick 101 and is preferably made of light gauge aluminum for optimal heat transfer kinetics. The wall of this reservoir 102 can be made of any material that can withstand the heat and chemical nature of the fuel but is preferred to have heat transfer properties in the range of metal or glass. The remote fuel reservoir 103 extends in a radial direction from the proximal fuel reservoir 102 and holds the great bulk of the solid fuel material. The fuel used in this apparatus can be any appropriate fuel, but preferably a paraffin wax similar to those used in candles and candle making, whose melt range is between 110 degrees F. and 190 degrees F. The remote fuel reservoir 103 may resemble a bowl, but preferably includes perforations at least on the horizontal portion of the piece to facilitate melted fuel delivery to the melted fuel reservoir 104. The remote fuel reservoir 103 is preferably made of aluminum for optimal heat transfer but can be made of any suitable heat and chemical tolerant material that possesses sufficient heat transfer properties to melt the solid fuel held within. Other materials include but are not limited to: stainless steel, copper, glass, and graphite. The melted fuel reservoir 104 rests directly beneath the remote fuel reservoir 103 and receives the melted fuel from the remote fuel reservoir 103 by gravity flow. The perforated bottom of the remote fuel reservoir 103 facilitates with the lower portion of the sintered glass wick 101 to keep the melted fuel reservoir 104 sufficiently warm to keep the melted fuel in its liquid state. The liquid fuel is then delivered to a flame via the wick 101 from the melted fuel reservoir 104. The partially elevated perforated floor of the remote fuel reservoir 103 also assists in keeping the surface of the wax pool hotter, so it best delivers the bulk of any volatile active ingredient. Volatile active ingredients are often desirable for air dispersion and may include, but not limited to, fragrances, natural oils, insect repellents, medicinal actives, and physiological actives. The base of the assembly 105 can be made of any material suitable for the heat of the system and chemical nature of the fuel. Suitable materials include but are not limited to, glass, steel, aluminum, copper, brass, and high melting point plastic resins. The entire assembly can then be mounted on a traditional stake 107 via an appropriate post interface 106.

Figure 2:
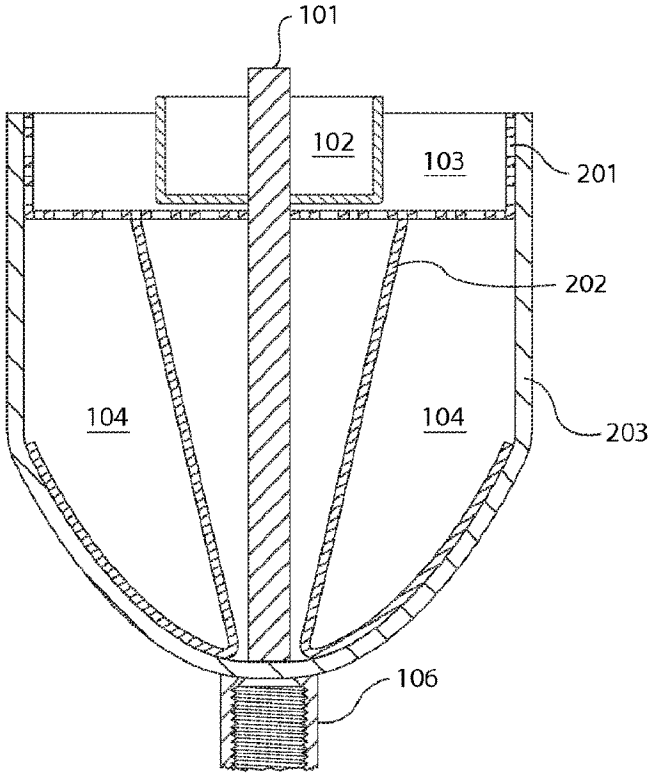
FIG. 2 is a cross-section view of an alternate yard torch embodiment of the invention with a more vertical orientation to emulate the appearance of prior art torches.

FIG. 2 shows a more traditional looking torch product, more vertical in design. In this assembly, however, it is important to manage the heat and space within the melted fuel reservoir 104 and the remote fuel reservoir 103 differently. Specifically, the assembly of the remote fuel reservoir 103 no longer resembles a flat bowl. Rather, it looks more like a pin-wheel or flower with alternating petal or tines that form the general boundary 201 of the remote fuel reservoir 103 and deliver heat throughout the melted fuel reservoir 202. In such an assembly then, the boundary between the remote fuel reservoir 103 and the melted fuel reservoir 104 becomes blurred. This type of design enables a vertical design in a more cylindrical or tubular housing 203.

Figure 3:
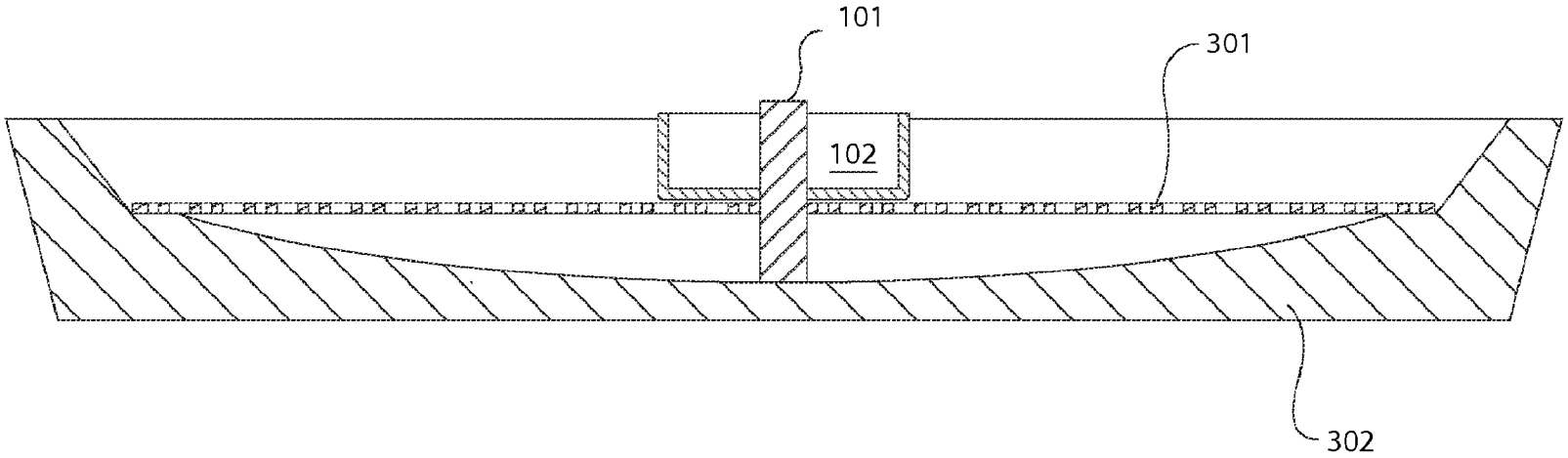
FIG. 3 is a cross-section view of a table top or indoor lamp embodiment of the invention that maximizes the exposed melt pool surface area for improved volatile delivery.
Figure 4:
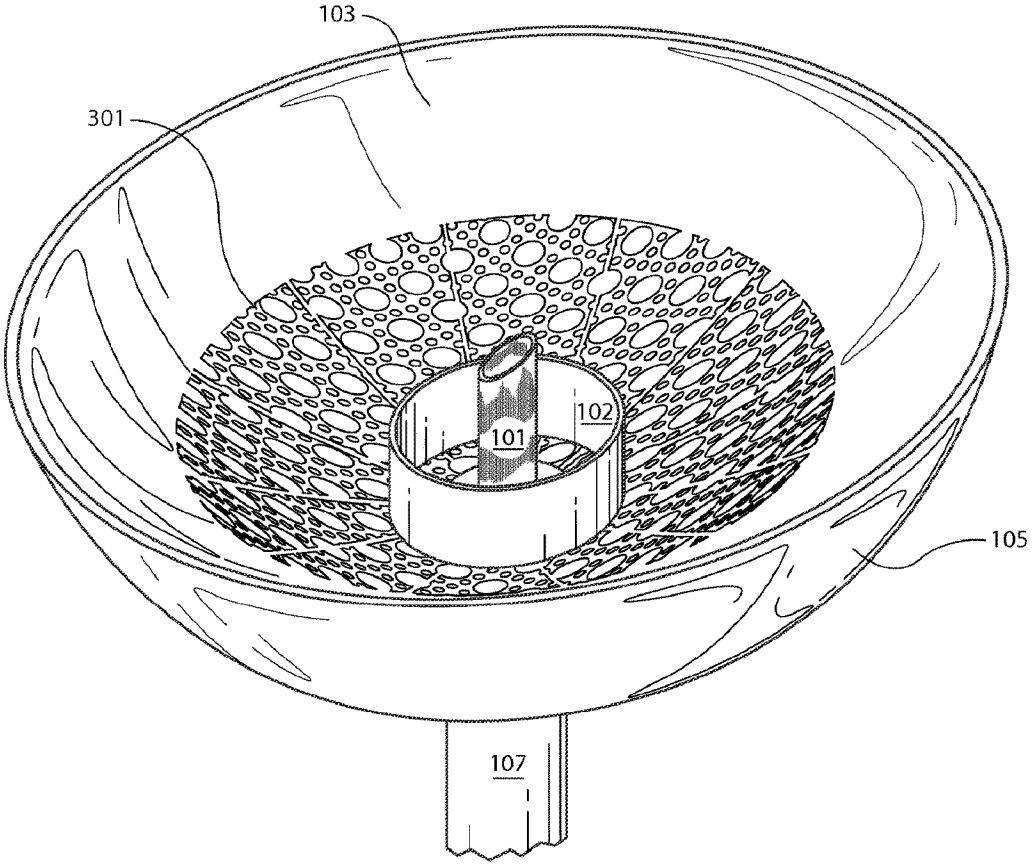
FIG. 4 is an oblique view of a yard torch embodiment of the invention.
Figure 5:
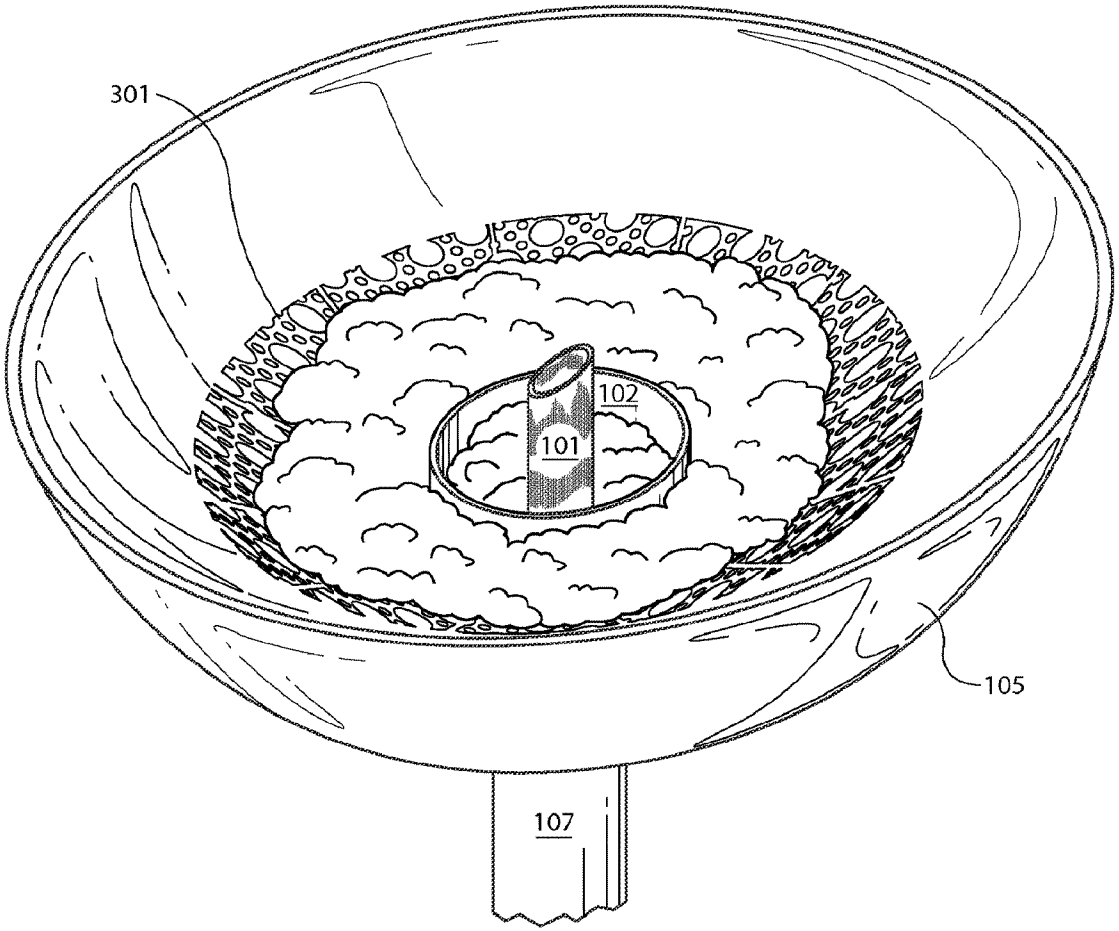
FIG. 5 is an oblique view of a yard torch embodiment of the invention.
Figure 6:
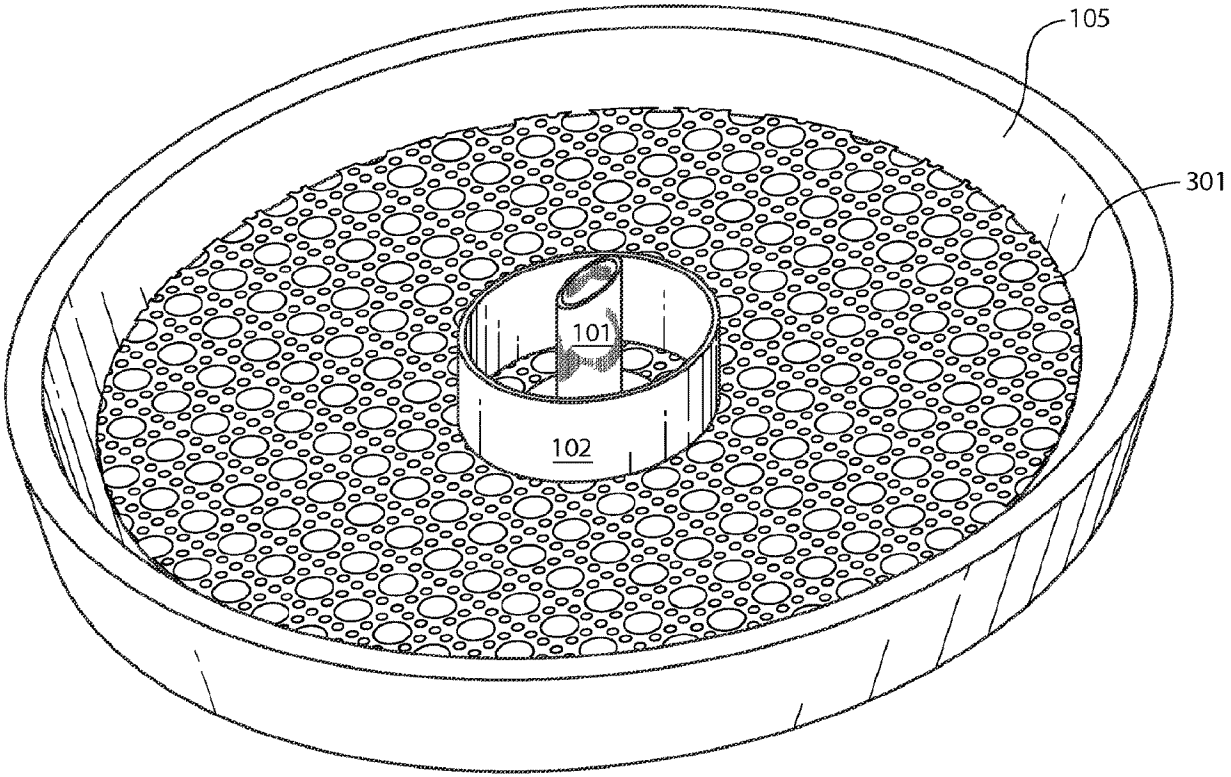
FIG. 6 is an oblique view of a table top or indoor lamp embodiment of the invention.
Figure 7:
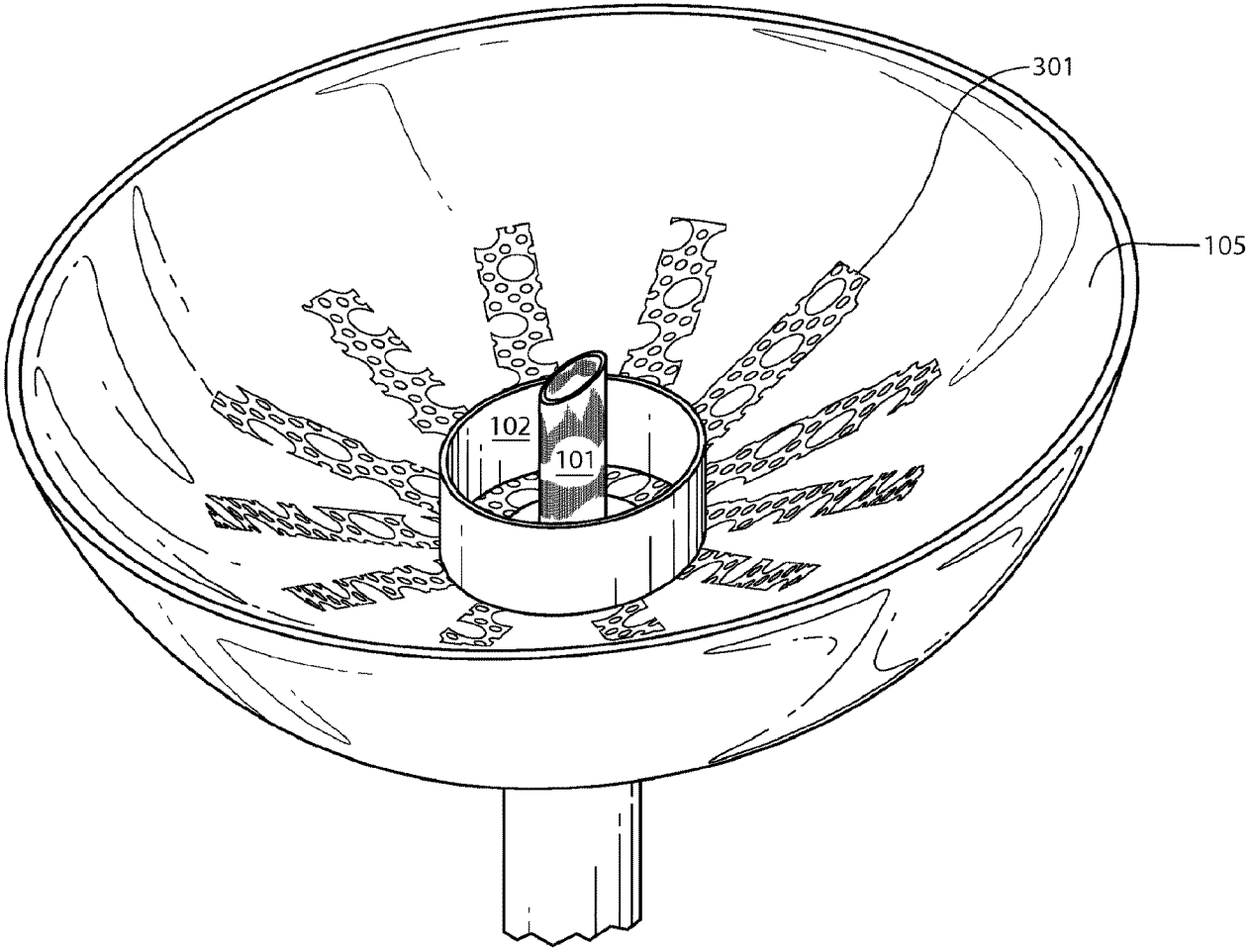
FIG. 7 is an oblique view of a second embodiment yard torch of the invention.
Figure 8:
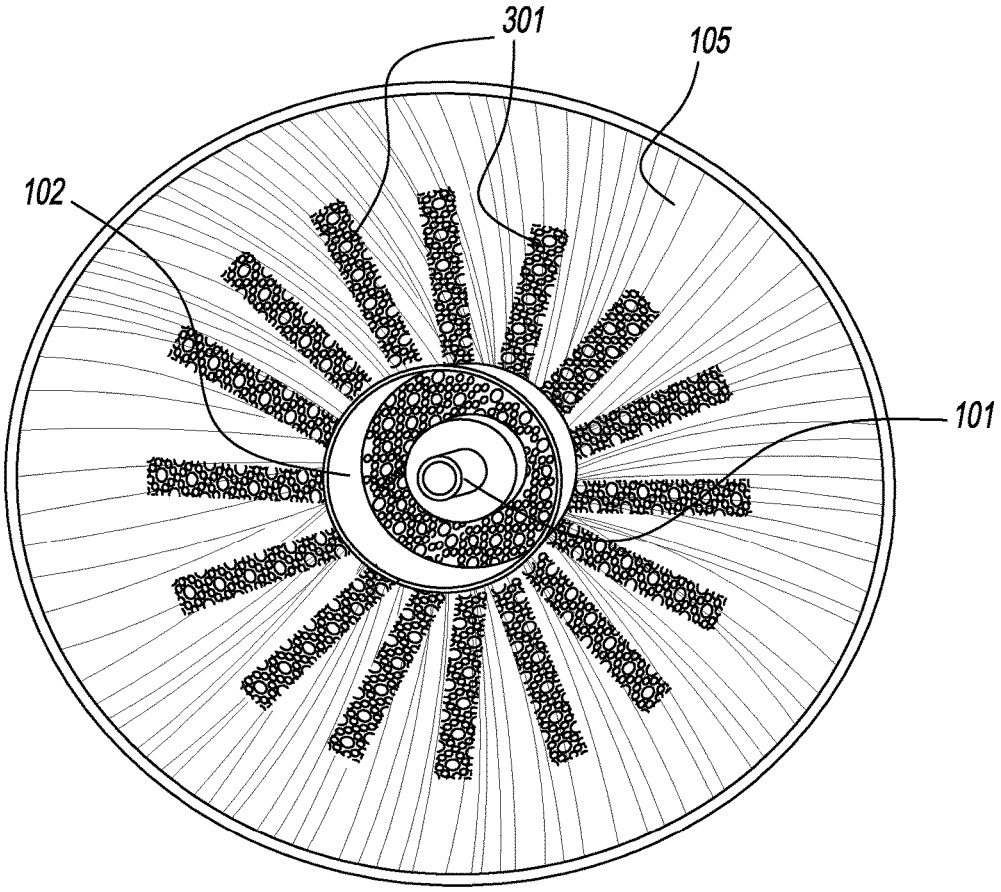
FIG. 8 is a top perspective view of the second embodiment yard torch of the invention.

FIG. 3 is an illustration of an embodiment intended for indoor or tabletop use, where it is generally desirable to more effectively deliver a volatile active ingredient, such as a fragrance, essential oil, medicinal, or physiological active. The basic wick 101 and proximal fuel reservoir 102 are similar to that of FIGS. 1 and 2. However, to maximize the size, to reduce the creation time, and to increase the operating temperature of the melt pool, the focus of the heat transfer from the flame is radial. In this manner, then, the remote fuel reservoir is formed by using a flat perforated heat conductive floor 301. The overall lower profile design also minimizes loss of heat to a bulk liquid while maximizing the exposed surface area of the melted fuel. The end result is a faster and more complete delivery of a volatile active ingredient held within the fuel. This lower profile design also requires an alternative housing 302 that is suitable for a tabletop. This embodiment is well suited for restaurants looking for improvements on candles and liquid fuel lamps.

Alternatives to the preferred mode include but are not limited to:

(1) using a hollow wick to improve fuel efficiency and create controllable, dynamic, or other novel flame effects;

(2) employing the proximal fuel reservoir, once depleted of fuel, as a burn chamber to increase the effective diameter, apparent size, and dynamic appearance of a torch flame;

(3) designing the system to both work well with solid fuel and safely burn liquid fuel;

(4) staging remote fuel reservoirs sequentially further from the flame or using housings composed of differing heat transfer properties such that different fuels (and active ingredients) can be staged or changed in time; and/or (5) using a fuel composed of one part lower melting wax and a comparatively higher level of active ingredient to melt first and provide a quick hit (to quickly and completely repel pests or to quickly fill a room with fragrance) that acts as a bolus to charge the room or environment with the content of the active ingredient.

Compared to the prior art, the present invention provides a more efficient use of the heat generated by the flame to spread throughout the system to melt the fuel for burning. The wall of the remote fuel reservoir 103 uses both sides to transfer heat to the fuel to supply melted fuel to the burning system. The general cup nature of the proximal fuel reservoir 102 engages the flame more intimately and thereby manages the system heat flux more efficiently, using the heat of the flame. In both respect, the present invention offers more efficient use of the heat generated by the flame and more efficient distribution of that heat throughout the system.

The fuel may use a second part with less active ingredient (or none) to sustain the flame and facilitate complete delivery of the composition held within the lower melting component, to act as a maintenance phase to keep pests at bay or to keep a room filled with fragrance An alternate housing design for certain applications may include a lid on the system to prevent spillage of fuel or accidental contact with the hot fuel and surfaces.

While particular elements, embodiments, and applications of the present invention have been shown and described, the invention is not limited thereto because modifications may be made by those skilled in the art, particularly in light of the foregoing teaching. It is therefore contemplated by the application to cover such modifications and incorporate those features which come within the spirit and scope of the invention.

We claim:

1. A torch for burning a meltable solid fuel, comprising:

a wick;

a proximal fuel reservoir surrounding the wick, the proximal fuel reservoir comprises a proximal fuel reservoir floor and a solid vertical perimeter wall, the solid vertical perimeter wall is spaced apart from the wick, the proximal fuel reservoir floor comprises a wick aperture, the proximal fuel reservoir floor is solid outside of the wick aperture and the perimeter wall is connected to the proximal fuel reservoir floor to contain melted fuel within the proximal fuel reservoir;

a remote fuel reservoir surrounding the proximal fuel reservoir, the solid vertical perimeter wall provides a fluid-impermeable boundary between the proximal fuel reservoir and the remote fuel reservoir;

a liquid fuel reservoir located beneath the proximal fuel reservoir and remote fuel reservoir;

the remote reservoir comprising a melting grate floor, the melting grate floor comprising a plurality of apertures to allow a melted fuel to flow through the melting grate floor and into the liquid fuel reservoir;

the wick extends from the liquid fuel reservoir, through the wick aperture in the proximal fuel reservoir floor, and into the proximal fuel reservoir.

2. The torch of claim 1, wherein the melting grate floor extends under the proximal fuel reservoir.

3. The torch of claim 1, wherein the melting grate floor is a heat conductive melting grate.

4. The torch of claim 1, wherein the wick is a free standing wick.

5. The torch of claim 1, wherein the wick comprises a hollow-core extending through the wick.

6. The torch of claim 1, wherein the proximal fuel reservoir is a burn chamber.

7. The torch of claim 1, comprising a bowl, at least a portion of the bowl comprises the liquid fuel reservoir and at least a portion of the bowl comprises the remote fuel reservoir;

the solid vertical perimeter wall is cylinder, the solid vertical perimeter wall segregates a flame burning on the wick from a fuel within the remote reservoir;

a top of the solid vertical perimeter wall is adjacent a top end of the wick;

the melting grate floor is supported on the bowl;

the wick comprises a hollow core extending through the wick;

the proximal fuel reservoir is a burn chamber;

the wick extends through the proximal fuel reservoir; and, the wick is partially sheathed within the proximal fuel reservoir.

8. A wax burning device, comprising:

a melted wax reservoir;

a wick;

a remote reservoir located above at least a portion of the melted wax reservoir;

a proximal reservoir located above at least a portion of the melted wax reservoir, the proximal reservoir located closer to the wick than the remote reservoir, the proximal reservoir comprises a proximal reservoir floor and a solid perimeter wall surrounding the wick and defining a fluid-impermeable perimeter boundary of the proximal reservoir, the perimeter wall is located between the wick and the remote reservoir, the perimeter wall is spaced apart from the wick, the proximal reservoir floor comprising a wick aperture;

a melting grate positioned to support a solid wax fuel in the remote reservoir, the melting grate located above at least a portion of the melted wax reservoir so that a solid wax melted on the melting grate is received into the melted wax reservoir, the melting grate comprising one or more apertures to allow a melted wax to flow through the melting grate and into the melted wax reservoir;

the wick extends from the melted wax reservoir, through the wick aperture, and into the proximal fuel reservoir.

9. The device of claim 8, wherein the remote reservoir is radially adjacent to the proximal reservoir.

10. The device of claim 8, wherein the proximal reservoir comprises a solid floor that joins with the perimeter wall to contain melted wax within the proximal fuel reservoir.

11. The device of claim 8, wherein the melting grate extends under the proximal reservoir to allow liquid fuel to flow from the proximal reservoir through the melting grate and into the melted wax reservoir.

12. The device of claim 8, wherein the melting grate is a heat conductive melting grate, and the perimeter wall is a heat conductive perimeter wall.

13. The device of claim 8, wherein the wick comprises a hollow-core extending through the wick.

14. The device of claim 8, wherein the proximal reservoir is a burn chamber defined by the perimeter wall.

15. The device of claim 8, comprising a wax fuel located in the proximal reservoir or the remote reservoir, the wax fuel comprises a first wax and a second wax, the first wax comprises a lower melting point relative to the second wax.

16. The device of claim 8, comprising a wax fuel located in the proximal reservoir or the remote reservoir, the wax fuel comprises a first wax and a second wax, the first wax comprises a higher concentration of an active ingredient relative to the second wax.

17. The device of claim 16, wherein the active ingredient is selected from a group consisting of: fragrances, natural oils, insect repellents, medicinal actives, and physiological actives.

18. A method of burning a meltable solid fuel, comprising:

melting a first solid fuel in a proximal reservoir to convert the first solid fuel into a first liquid fuel, the proximal reservoir surrounds a wick;

fueling a flame on the wick with the liquid fuel in the proximal reservoir;

melting a second solid fuel in a remote reservoir into a second liquid fuel with heat from the flame burning on the wick while segregating the second solid fuel from the flame and the proximal reservoir with a solid fluid-impermeable perimeter wall surrounding the wick and being spaced apart from the wick, the remote reservoir surrounding the proximal reservoir; and, flowing the second liquid fuel from the remote reservoir into the liquid fuel reservoir below the remote reservoir by gravity to fuel the wick extending into the liquid reservoir from the proximal reservoir.

19. The method of claim 18, comprising the step of exhausting the first fuel in the proximal reservoir so that the proximal reservoir acts as a burn chamber.

20. The method of claim 18, wherein the step of melting a second solid fuel comprises the step of deterring an active ingredient of the second solid fuel from being consumed by the flame on the wick by segregating the second solid fuel from the flame with the solid perimeter wall.

* * * * *